US005368518A

United States Patent [19]

Hitchcock

[11] Patent Number: 5,368,518

[45] Date of Patent: Nov. 29, 1994

[54] PUPPET HEAD

[76] Inventor: Elise G. Hitchcock, 2809 NW. 35th Pl., Gainesville, Fla. 32605

[21] Appl. No.: 82,434

[22] Filed: Jun. 28, 1993

Related U.S. Application Data

[63] Continuation of Ser. No. 835,329, Feb. 14, 1992, abandoned.

[51] Int. Cl.[5] ..... A63H 3/14; A63H 3/02

[52] U.S. Cl. ..... 446/329; 446/372

[58] Field of Search ..... 446/26, 27, 28, 327, 446/328, 329, 368, 369, 371, 372, 376, 366, 367, 390, 391, 395, 268

[56] References Cited

U.S. PATENT DOCUMENTS

| | | | |
|---|---|---|---|
| D. 167,289 | 7/1952 | Tillstrom . | |
| D. 241,043 | 8/1976 | Bacerella. Jr. . | |
| D. 268,430 | 3/1983 | Rodgers . | |
| 1,267,567 | 5/1918 | Lundgren | 446/28 X |
| 2,756,997 | 7/1956 | Heintzelman | 446/27 |
| 2,795,896 | 6/1957 | Snyder . | |
| 2,929,170 | 3/1960 | Brown . | |
| 3,034,255 | 5/1962 | Bacon . | |
| 3,308,479 | 3/1967 | Sesco, Jr. | 446/28 X |
| 3,526,990 | 9/1970 | Edmonds | 446/327 |
| 4,244,142 | 1/1981 | Crawford | 446/329 X |
| 4,268,918 | 5/1981 | Lee | 446/27 X |
| 4,300,307 | 11/1981 | Biasuzzi et al. | 446/328 OR |
| 4,778,172 | 10/1988 | Bryan | 446/395 X |
| 4,799,889 | 1/1989 | Yockey | 446/328 X |
| 4,944,710 | 7/1990 | Sommers | 446/329 |
| 5,080,626 | 1/1992 | Maddi | 446/329 |
| 5,117,507 | 6/1992 | Long | 446/329 X |

FOREIGN PATENT DOCUMENTS

| | | | |
|---|---|---|---|
| 2946946 | 6/1981 | Germany | 446/327 |
| 604520 | 3/1960 | Italy | 446/329 |

*Primary Examiner*—Robert A. Hafer
*Assistant Examiner*—D. Neal Muir
*Attorney, Agent, or Firm*—Finnegan, Henderson, Farabow, Garrett & Dunner

[57] ABSTRACT

The invention relates to a puppet which is manipulated by both arms of a user primarily as a form of cheering for a person or entity during sporting and similar events. The puppet comprises a first member including a first elongated sleeve into which a first arm of the user may be inserted. A second member is secured to the first member and includes a second elongated sleeve into which a second arm of the user may be inserted. The first and second members cooperate to provide a puppet in the shape of a mascot or character identified with the person or entity being cheered. The first and second members are secured together in a manner which permits the user to impart relative motion through arm movements.

20 Claims, 1 Drawing Sheet

PUPPET HEAD

This application is a continuation of application Ser. No. 07/835,329 filed Feb. 14, 1992, now abandoned.

BACKGROUND OF THE INVENTION

1. Field of the Invention

The present invention relates to a puppet which is manipulated by both arms of a user primarily as a form of cheering for a person or entity during sporting and similar events. The puppet includes a first member which forms a first elongated sleeve for receiving one arm of the user and a second member associated with the first member which forms a second elongated sleeve to receive the second arm of the user. More particularly, the first and second members cooperate to provide a puppet in the shape of a mascot or characterization of the person or entity being cheered. The user imparts relative motion between the first and second members through movements of both arms.

2. Description of the Prior Art

It is known to construct a puppet having a sleeve or body as its main portion which receives an arm, finger or hand of a user. The movements of the puppet are effected by the respective arm, finger or hand located within the puppet. Thus, with this type of puppet, movement is necessarily limited to only the movements imparted by this single arm, hand or finger.

It is also known to form a puppet as a head of an animal or other character. For example, with a hand puppet formed into a head of an animal, the thumb is received in one portion of the puppet and the remaining fingers in a second portion. Animation of the puppet is accomplished by moving the fingers and thumb in relation to each other, thus opening and closing the mouth. However, once again the field of movement of the puppet is limited to the amount of movement possible with the use of only a single arm, hand or finger.

As disclosed in U.S. Pat. Nos. 2,795,896, 2,929,170, and 3,034,255, a body or sleeve portion of a puppet is designed to receive one arm of a user. A head of the puppet receives the hand, with the thumb inserted into a lower portion and the remaining fingers in a upper portion. With the above puppets, animation is accomplished solely by the movement of the single hand or arm.

It is also well known that professional, college, and high school sporting teams, as well as other competing persons and entities, often have mascots or similar characters or characterizations that are identified with the team or person. It is further known that novelty representations of such mascots, characters, or characterizations are sometimes used by fans of the team or person to cheer on that team or person. Such novelty representations typically are of the type that can be held and/or operated by one arm of the fan. The size and manner of control of these novelty items therefore limits the overall effect of cheering by fans using such novelty items.

SUMMARY OF THE INVENTION

It is therefore an object of the present invention to provide an improved puppet, or cheer mitts, which represents a team mascot or similar characterization and permits active and highly visible and effective cheering by fans during a sporting or similar event. It is another object to provide such a puppet which is sized to fit over most, if not all, of a user's arms and is operated by both arms of a user. Yet another object is to provide such a cheer mitts puppet having two sleeve portions into each of which a user inserts one of his arms, so that the animation of the puppet can be effected by movements of both arms of the user.

Still another object of the invention is to provide a puppet that forms the head and mouth of an animal or team mascot, wherein relative movement of both arms of the user opens and closes the mouth of the puppet.

Another object is to provide a novelty puppet into which a user can insert both arms.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a puppet to be manipulated by a user primarily as a form of cheering for a person or entity during sporting and similar events, the puppet comprising a first member including a first elongated sleeve into which a first arm of the user may be inserted, and a second member associated with the first member, the second member including a second elongated sleeve into which a second arm of the user may be inserted, the first and second members cooperating to provide a puppet in the shape of a mascot or character identified with the person or entity being cheered, whereby the user through arm movements can impart animation to the puppet by relative motion between said first and second members. The first and second members preferably are secured to each other in a manner that permits one member to pivot relative to the other. In addition, the first and second members are preferably sized to extend along substantially the entire length of the user's arm, thereby maximizing the visual impact of the puppet when it is used for cheering.

To achieve the objects and in accordance with the purpose of the invention, as embodied and broadly described herein, the first and second members preferably combine to form a characterization of an animal associated with the team being cheered. Still more preferably, the first and second members combine to form a head and mouth of the animal, and the relative movement of the first and second members opens and closes the mouth of the depicted animal.

It is to be understood that the foregoing general description and the following detailed description are exemplary and explanatory only and are not restrictive of the invention, as claimed.

The accompanying drawings, which are incorporated in and constitute a part of this specification, illustrate several embodiments of the invention and, together with the description, serve to explain the principles of the invention.

DETAILED DESCRIPTION OF THE INVENTION

Figure 1:
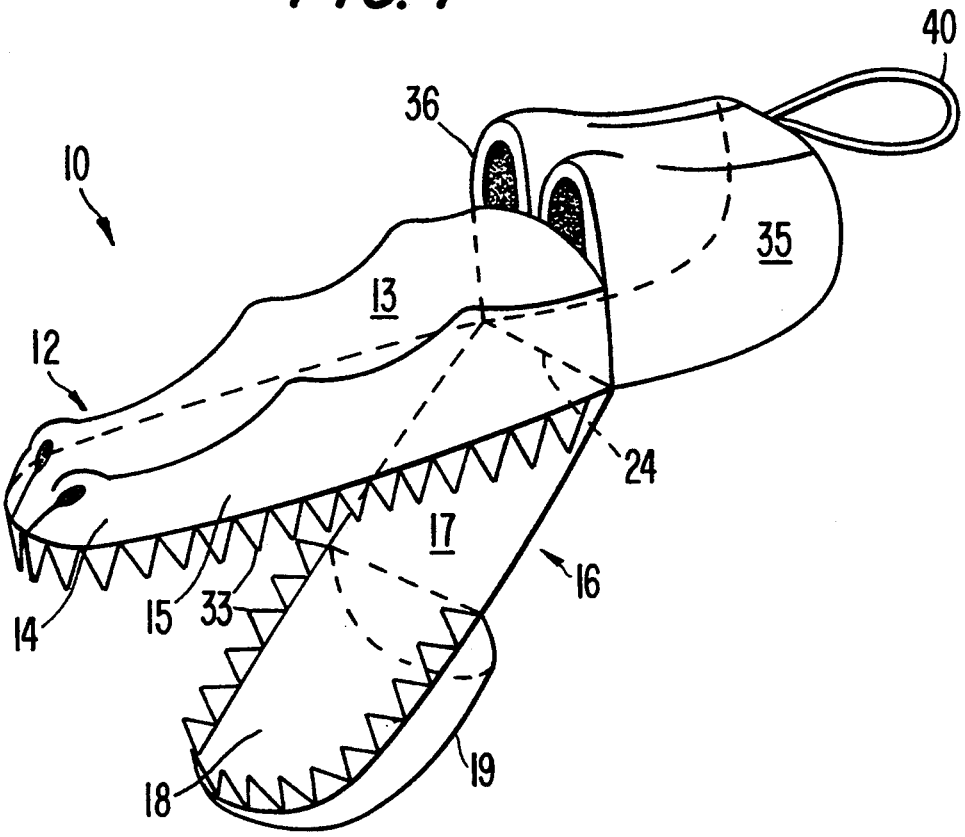
FIG. 1 is a perspective view of the puppet of the present invention.

Reference will now be made in detail to the present preferred embodiments of the present invention, examples of which are illustrated in the accompanying drawings. Wherever possible, like reference numbers have been used to refer to like parts.

As illustrated, the present invention is directed to a puppet 10 to be manipulated by both arms of a user. The present invention has particular application as a form of cheering for a person or entity during sporting and similar events. For example, a puppet shaped in the form of a mascot or characterization of a college or professional football team can be used, preferably by a large number of fans during a group-participation cheer, to cheer on the team. Solely for illustrative purposes, the puppet or cheer mitts shown in the drawings is in the form of an alligator, the mascot or representation of the University of Florida Gators. As is obvious from the description of the invention presented in this application, the puppet or cheer mitts of the present invention can be formed into a wide variety of shapes.

Figure 2:
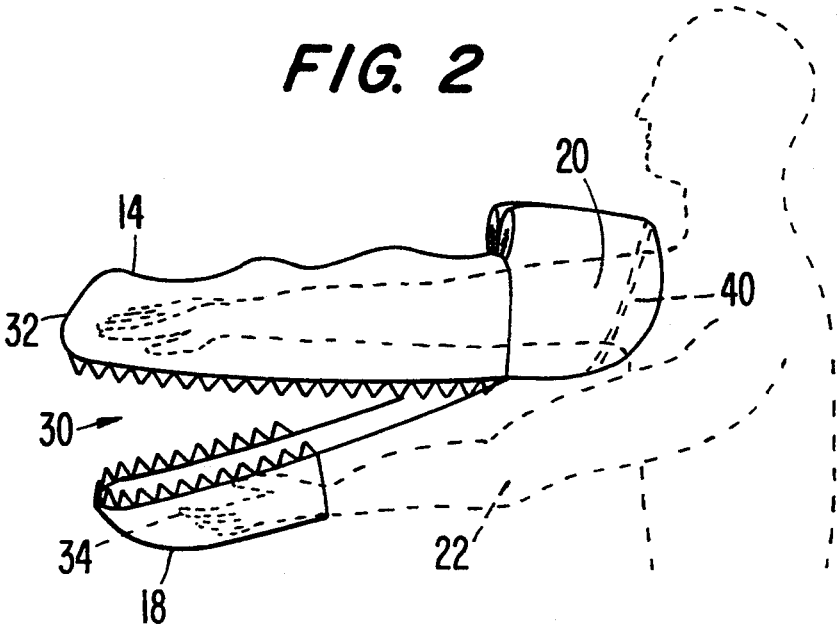
FIG. 2 is a sectional view of the puppet illustrating the position of the arms of the user during use.

FIG. 1 is a perspective view of one embodiment of the puppet according to the present invention. The puppet, as shown in FIG. 1 and generally referred to as numeral 10, includes a first member 12 which comprises a first elongated sleeve 14 into which a first arm 20 of a user is inserted (FIG. 2). The puppet also includes a second member 16 which includes a second elongated sleeve 18 into which a second arm 22 of the user can be inserted (FIG. 2). The second member 16 is associated with the first member 12 and preferably is secured to the first member. As shown in FIGS. 1 and 2, the first 12 and second 16 members are sized so that they extend along substantially the entire lengths of the user's arms, thereby maximizing the visual impact of the puppet when it is operated. Preferably, the length of the members should be within the range of 16 to 22 inches for adults, and 10 to 16 inches for children. Sleeve 18, as illustrated in FIG. 1, extends partially along a user's second arm. However, the sleeve can be fashioned to extend along substantially the entire length of the user's arm.

The first and second members cooperate to provide a puppet in the shape of a mascot or character identified with the person or entity being cheered. The drawings illustrate the puppet having a form of an alligator. As shown, the first member 12 includes a head portion and an upper jaw or snout portion, and the second member 16 provides the lower jaw of the alligator. However, it should be apparent that the puppet of the present invention can be designed in the shape of a variety of mascots or characters and is not limited to the specific puppet illustrated in the drawings.

In the preferred embodiment, first 12 and second 16 members are pivotally secured together in a manner that permits the user to impart relative motion between the members through movements of one or both arms. In the embodiment shown in FIG. 1, the end 24 of second member 16 is pivotably attached to first member 12 along a line perpendicular to the longitudinal axis of the first member and positioned intermediate the two ends of the first member. As shown, this line is adjacent the point where the snout portion of the first member meets with the head portion of the first member.

In the preferred embodiment, the members 12 and 16 of the puppet of the present invention are sufficiently long to permit the relative rotation of a user's arms through a wide arc. Preferably, the cheer mitt is designed to permit at least a 90° rotation of the arms from the closed position of the puppet to a fully open position. To achieve this result, a portion of one or both of the members proximate their point of intersection can be folded in an accordion-like fashion and/or elasticized, so that it will return to an unexpanded state when it is released. The members 12, 16 can be pivotally attached by sewing or by any other conventional means.

As shown in FIG. 1 and FIG. 2, first member 12 includes a first top portion 13 and a first bottom portion 15 secured to each other to form first elongated sleeve 14. Second member 16 includes a second top portion 17 and a second bottom portion 19 to form the second elongated sleeve 18. The respective top and bottom portions form sleeves 14, 18 and can be comprised of fabric or other appropriate material sewn or otherwise secured together along the edges. It is intended that each of sleeves 14, 18 retain at least one open end for insertion of the user's arms.

A carrying means 40 preferably is disposed on at least one of the first or second members 12, 16 to allow the user to easily hold or transport the puppet when it is not in use. As illustrated in FIG. 1 and FIG. 2, carrying means 40 can comprise an elastic band or a fabric loop. The loop can be attached to a belt or belt loops of the user and also can be positioned over a user's head so that the user can quickly insert his arms into the puppet and cheer. It should be apparent that many other alternative carrying means can be applied to the present invention.

As embodied and depicted in FIGS. 1 and 2, first and second members 12, 16 combine to from the characterization of an animal, for example an alligator. The first member includes a head 35 which in this embodiment is part of the first top portion 13 of the first member 12. The head 35 is comprised of a suitable fabric or similar material. In the illustrated embodiment, a pair of eyes are incorporated in the head of the puppet. For other types of mascots, hair, ears, a nose, and other facial features may be added to the head portion of the puppet.

First and second members 12, 16 preferably combine to form the mouth 30 of the animal. The relative movements of members 12, 16 by the user's arms act to open and close mouth 30. Mouth 30 is formed by first bottom portion 15 of first member 12 and the second top portion 17 of second member 16. Preferably, the mouth portion of the a puppet is a different color than the main body of the puppet, thereby adding to the visual impact of the invention.

As shown in the illustrated embodiment, first member 12 may form an upper jaw or a snout 32 of the animal, and second member 16 may form a lower jaw 34. At least one of the first and second members preferably includes a row of teeth 33. In the preferred embodiment, teeth are positioned in both the first and second members and are in substantial alignment with each other. Again, the teeth preferably have a different color than the mouth or the main body portion of the cheer mitt of the present invention.

The puppet is preferably operated by manipulation of both of the user's arm to create relative movement between the first and second members. The puppet of the present invention provides several benefits not found in conventional one-armed puppets. For example, a large degree of movement due to the use of both arms increases the animation of the puppet. Such puppets are particularly suited for use at a sporting event, since highly visible and effective cheering for an athletic team can be accomplished through arm movements of one or more users. It should be readily apparent that the widespread use of the puppet or cheer mitt of the present invention by a crowd of fans will have a substantial visual effect upon the team being cheered and the fans. The use of such cheer puppets will add to the enjoyment of the event being observed. The puppet itself can be fashioned of material which has the same colors or patterns as the team being cheered or the character being represented.

Other embodiments of the invention will be apparent to those skilled in the art in consideration of the specification and practice of the invention disclosed herein. For example, miniature embodiments of the present invention can be used as toys or novelty items. It is intended that the specification and examples be exemplary only, with a true scope and spirit of the invention being indicated by the following claims and all equivalents thereof.

What is claimed is:

1. A puppet head to be manipulated by the arms of the user, the puppet head comprising:

a head element including a mouth, said head element including an aperture extending therethrough;

a first member forming an upper jaw of the mouth, said first member including a first elongated sleeve coextensive with said head aperture into which the first arm of the user is inserted during use, said first member extending along a first longitudinal axis;

a second member forming the lower jaw of the mouth, said second member being attached to said first member in a manner which permits relative motion between the first and second members, said second member including a second elongated sleeve into which the second arm of the user is inserted during use, said second elongated sleeve being opposite to and independent from said first member and said head;

said first and second members being hinged together so as to allow said second and first members to provide relative movement that simulate movement of the mouth of the puppet head;

wherein a user through arm movement can impart animation to the puppet head by one arm operating the upper jaw and the other arm operating the lower jaw of the mouth of the puppet head.

2. The puppet head according to claim 1 wherein at least one of said first and second members includes a row of teeth.

3. The puppet according to claim 1 wherein said second member is hinged to said first member along a line that is substantially perpendicular to the longitudinal axes of said first and second members.

4. The puppet according to claim 1 wherein a pair of eyes are disposed on said first member.

5. The puppet according to claim 1 wherein said finest and second members are sized to extend along substantially the entire length of a user's arm.

6. The puppet according to claim 1 further comprising a carrying loop attached to at least one of said first and second members.

7. The puppet according to claim 1 wherein said first member includes a first top portion and a first bottom portion secured to each other to form the first elongated sleeve and the second member includes a second top portion and a second bottom portion secured to each other to form the second elongated sleeve.

8. A puppet head to be manipulated by the arms of the user, the puppet head comprising:

a first member including a first elongated sleeve into which a first arm of the user is inserted during use, said first member extending along a first longitudinal axis, being sized to extend along substantially the entire length of a user's arm, and forming the head and an upper jaw of an animal;

a second member including a second elongated sleeve into which the second arm of the user is inserted during use, said second member extending along a second longitudinal axis, being sized to extend along substantially the entire length of a user's arm, and forming a lower jaw of an animal;

said second member being secured to said first member along a line substantially perpendicular to the longitudinal axes of said first and second members, to allow said first and second members to provide relative movement that simulates movement of the mouth of the puppet head;

whereby a user through arm movement can impart animation to the puppet head by one arm operating the upper jaw and the other arm operating the lower jaw of the mouth of the puppet head.

9. The puppet head according to claim 8 wherein a pair of eyes are formed in the head and a plurality of teeth are formed or at least one of said first and second members.

10. The puppet head according to claim 8 wherein each of said first and second members include a row of teeth substantially in alignment with each other.

11. The puppet head according to claim 8 wherein a pair of eyes are disposed on said first member.

12. The puppet according to claim 8 further comprising carrying means disposed on at least one of said first and second members.

13. The puppet according to claim 8 wherein said first member includes a first top portion and a first bottom portion secured to each other to form the first elongated sleeve and the second member includes a second top portion and a second bottom portion secured to each other to form the second elongated sleeve.

14. A puppet head to be manipulated by the arms of the user, the puppet head consisting essentially of:

a head element including a mouths, said head element including an aperture extending therethrough;

a first member forming an upper jaw of the mouth, said first member including a first elongated sleeve coextensive with said head aperture into which the first arm of the user is inserted during use, said first member extending along a first longitudinal axis;

a second member forming the lower jaw of the mouth, said second member being attached to said first member in a manner which permits relative motion between the first and second members, said second member including a second elongated sleeve into which the second arm of the user is inserted during use, said second elongated sleeve being opposite to and independent from said first member and said head;

said first and second members being hinged together so as to allow said second and first members to provide relative movement that simulates movement of the mouth of the puppet head;

wherein a user through arm movement can impart animation to the puppet head by one arm operating the upper jaw and the other arm operating the lower jaw of the mouth of the puppet head.

15. The puppet head according to claim 14 wherein at least one of said first and second members includes a row of teeth.

16. The puppet according to claim 14 wherein a pair of eyes are disposed on said first member.

17. The puppet according to claim 14 wherein said first and second members are sized to extend along substantially the entire length of a user's arm.

18. The puppet according to claim 14 further comprising a carrying loop attached to at least one of said first and second members.

19. The puppet according to claim 14 wherein said first member includes a first top portion and a first bottom portion secured to each other to form the first elongated sleeve and the second member includes a second top portion and a second bottom portion secured to each other to form the second elongated sleeve.

20. The puppet head according to claim 14 wherein said second member is hinged to said first member along a line that is substantially perpendicular to the longitudinal axes of said first and second members.

* * * * *